United States Patent [19]

McMillan

[11] 4,138,623

[45] Feb. 6, 1979

[54] LAMP LEADS

[75] Inventor: John E. McMillan, Kirtland, Ohio

[73] Assignee: General Electric Company, Schenectady, N.Y.

[21] Appl. No.: 889,265

[22] Filed: Mar. 23, 1978

Related U.S. Application Data

[63] Continuation of Ser. No. 734,567, Oct. 21, 1976, abandoned.

[51] Int. Cl.[2] ..... H01J 5/50

[52] U.S. Cl. ..... 313/331; 313/332

[58] Field of Search ..... 313/331, 332; 75/206, 75/207; 174/50.58, 50.61, 126 R

[56] References Cited

U.S. PATENT DOCUMENTS

| | | | |
|---|---|---|---|
| 2,716,714 | 8/1955 | Adams et al. | 313/332 |
| 3,143,789 | 8/1964 | Iler et al. | 75/206 |

*Primary Examiner*—Craig E. Church
*Assistant Examiner*—Robert E. Wise
*Attorney, Agent, or Firm*—Paul F. Wille; Lawrence R. Kempton; Frank L. Neuhauser

[57] ABSTRACT

Dispersion strengthened copper leads are used for inner and/or outer leads in electric lamps.

8 Claims, 2 Drawing Figures

LAMP LEADS

This is a continuation of application Ser. No. 734,567, filed Oct. 21, 1976 now abandoned.

BACKGROUND OF THE INVENTION

This invention relates to electric lamps and, in particular, to an improved lead wire for electric lamps.

In the prior art, copper or various copper alloys have been used as the material for lead wire in electric lamps. A recurring problem has been the weakening or annealing of the copper during glass forming operations. As a specific example, in making incandescent lamps, the lead wires and exhaust tube are inserted into a flare and the smaller end of the flare is heated and pressed to make what is known as the stem.

The stem press operation softens the lead wires to the point that tie wires are used to assure lamp reliability, particularly against shock. The button forming and tie wire operations add steps to the manufacture of lamps, increasing cost and adding possible source of shrinkage (rejected lamps).

While a variety of materials have been tried as substitutes for the copper or copper-alloy lead wires, none had been found suitable. Metals or alloys that adequately withstand stem pressing at higher temperatures have too high a resistance, adversely affecting the efficacy of the lamp. While larger diameter wire might alleviate the problem somewhat, this solution causes other difficulties, such as increased cost and possible sealing problems.

SUMMARY OF THE INVENTION

In view of the foregoing, it is therefore an object of the present invention to provide an improved lead wire for electric lamps.

Another object of the present invention is to provide a lead wire capable of withstanding higher stem press temperatures.

A further object of the present invention is to provide an improved inner lead for electric lamps.

Another object of the present invention is to provide an improved outer lead for electric lamps.

A further object of the present invention is to provide a lead wire capable of withstanding higher stem press temperatures and having acceptable diameter and resistance characteristics.

The foregoing objects are achieved in the present invention wherein it has been found that dispersion strengthened copper wire withstands elevated press seal temperatures and, when used for the inner lead wires, eliminates the need for tie wires due to its retained stiffness.

BRIEF DESCRIPTION OF THE DRAWING

A more complete understanding of the present invention can be obtained by considering the following detailed description in conjunction with the accompanying drawing, in which.

DESCRIPTION OF THE PREFERRED EMBODIMENTS

Figure 1:
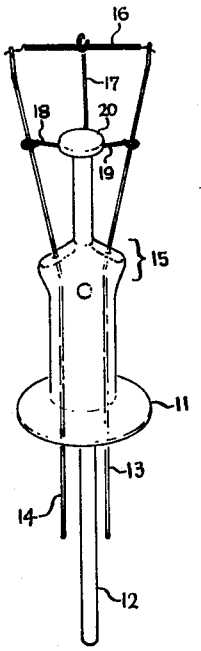
FIG. 1 illustrates a mount for an incandescent lamp in accordance with the prior art.

FIG. 1 illustrates a completed mount in accordance with the prior art. Specifically, the mount comprises a flare 11 having exhaust tube 12 and lead wires 13 and 14 inserted therein. As known to those of skill in the art, lead wires 13 and 14 each comprise three segments of conductive material. Specifically, lead wires generally comprise an outer conductor connected to an inner conductor by a short length of dumet wire which is positioned in pressed area 15 to provide a seal between the inside and outside of the glass envelope of the lamp. As illustrated in FIG. 1, the upper portion of the stem is inserted into the glass envelope. Thus, the portions of lead wires 13 and 14 extending upwardly from pressed area 15 constitute the inner lead wires while the portions of lead wires 13 and 14 extending downwardly from pressed area 15 constitute the outer lead wires.

The ends of the inner lead wires are connected one each to each end of refractory filament 16, generally comprising tungsten. Encircling the central portion of filament 16 is support wire 17. Encircling each of lead wires 13 and 14 are tie wires 18 and 19, the other ends of which are embedded in glass button 20 formed in the end of the exhaust stem.

In accordance with the prior art for low wattage gas-filled incandescent lamps, lead wires 13 and 14 generally comprise nickel-plated copper or copper alloy. In accordance with the present invention, illustrated in FIG. 2, the inner or outer leads may comprise what is known as a dispersion strengthened copper wire. Dispersion strengthening of metals is known in the art and, in particular, dispersion strengthened copper wire is known in the art and available from the Glidden Metals Division of SCM Corporation as "GlidCop" AL-20; the same material is available from GTE Sylvania, Inc., as DSC 200. This wire may be used for either the inner or outer leads and, for example, may comprise 10-mil diameter wire for the inner leads and 18-mil diameter wire for outer leads. As known by those of skill in the art, the outer surface of at least the inner lead wires comprises a nickel plate to eliminate contamination within the lamp due to the release of contaminants from the surface of the copper when the lamp is lighted.

It has been found that dispersion strengthened copper wire as described above does not soften or anneal in the fires used to soften the flare and exhaust tube prior to pressing. As a result, the lead wires in a finished mount are stiffer in accordance with the present invention, and the need for tie wires 18 and 19 are possibly the center support wire 17 is obviated.

Figure 2:
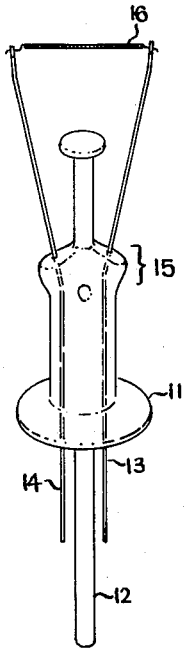
PRIOR ART Fig. 2
FIG. 2 illustrates a mount for an incandescent lamp in accordance with the present invention.

A completed mount in accordance with the present invention, as illustrated in FIG. 2, therefore merely comprises a flare 11, exhaust tube 12, lead wires 13 and 14, and a suitable filament 16. The construction of the mount is thus simplified without compromising lamp performance. The lead wires previously described have a resistance and diameter comparable to that of lead wires of the prior art. In addition, lamps in accordance with the present invention can be manufactured at higher seal temperatures.

As an inner lead for a standard incandescent lamp, ie. incandescent lamps used in what is known in the art as general service household lighting or general service illumination, lead wire in accordance with the present invention thus provides an improved lamp in which tie or support wires are unnecessary to help the lead wires tolerate shock or vibration.

What I claim as new and desire to secure by Letters Patent of the United States is:

1. A general service incandescent lamp having a mount comprising at least two inner lead wires;

a refractory filament clamped one end to each of said lead wires;

wherein the improvement comprises at least a portion of said lead wires comprising dispersion strengthened copper wire and at least said lead wires are unsupported.

2. The incandescent lamp as set forth in claim 1 wherein said inner lead wires are nickel plated.

3. A lamp as set forth in claim 1 wherein said filament is unsupported.

4. A mount for an electric lamp comprising:

a flare;

an exhaust tube inserted in said flare;

at least two lead wires inserted in said flare, said flare being pressed closed at one end thereof around said exhaust tube and lead wires;

at least one refractory metal filament connected to one end of each of said lead wires; and wherein the improvement comprises at least a portion of said lead wires comprising dispersion strengthened copper.

5. The mount as set forth in claim 4 wherein said inner lead wires are nickel plated.

6. The mount as set forth in claim 4 wherein said lead wires comprise inner and outer portions, said inner portions comprising said dispersion strengthened copper.

7. The mount as set forth in claim 6 wherein at least said inner lead wires are unsupported.

8. The mount as set forth in claim 7 wherein said filament is unsupported.

* * * * *